United States Patent [19]

Henrit

[11] 4,312,259

[45] Jan. 26, 1982

[54] PEDAL ADJUSTABLE DRUM

[75] Inventor: Robert J. Henrit, London, England

[73] Assignee: Remo, Inc., North Hollywood, Calif.

[21] Appl. No.: 67,737

[22] Filed: Aug. 20, 1979

[51] Int. Cl.[3] ..... G10D 13/02

[52] U.S. Cl. ..... 84/411 A; 84/419

[58] Field of Search ..... 84/411 A, 419, 422 R

[56] References Cited

U.S. PATENT DOCUMENTS

| | | | |
|---|---|---|---|
| 1,356,193 | 10/1920 | Danly | 84/419 |
| 1,458,905 | 6/1923 | Leedy | 84/415 |
| 1,561,789 | 11/1925 | Ludwig et al. | 84/419 |
| 1,722,032 | 7/1929 | Bower | 84/415 |
| 1,755,569 | 4/1930 | Strupe | 84/419 |
| 1,845,625 | 2/1932 | Robison | 84/419 |
| 1,853,466 | 4/1932 | Sigler | 84/419 |
| 2,074,194 | 3/1937 | Strupe | 84/419 |
| 2,198,406 | 4/1940 | Deans et al. | 84/419 |
| 2,205,593 | 6/1940 | Jeffries | 84/419 |
| 2,259,268 | 10/1941 | Robison | 84/419 |
| 2,261,119 | 11/1941 | Ludwig et al. | 84/419 |
| 2,548,271 | 4/1951 | Percy | 84/419 |
| 2,564,933 | 8/1951 | Somerville | 84/411 |
| 3,021,743 | 2/1962 | Ludwig | 84/419 |
| 3,125,921 | 3/1964 | Korosh | 84/422 R |
| 3,215,021 | 11/1965 | Kester | 84/411 |
| 3,279,299 | 10/1966 | Murbach | 84/419 |
| 3,685,389 | 8/1972 | Bemben | 84/411 |
| 3,701,834 | 10/1972 | Rubio | 84/419 |
| 3,747,463 | 7/1973 | Hinger | 84/419 |
| 4,048,895 | 9/1977 | May | 84/411 A |
| 4,056,998 | 11/1977 | Rampton | 84/419 |

FOREIGN PATENT DOCUMENTS

| | | | |
|---|---|---|---|
| 590803 | 8/1947 | United Kingdom | 84/419 |

OTHER PUBLICATIONS

Ludwig Catalog No '75-1 published by Ludwig Drum Company, 1974, pp. 54–60.

Slingerland Catalog 69, published by Slingerland Drum Company 1968, pp. 40–43.

*Primary Examiner*—L. T. Hix

*Assistant Examiner*—Alan Mathews

*Attorney, Agent, or Firm*—Lyon & Lyon

[57] ABSTRACT

A drum is adjustable in pitch by a pedal assembly connected by a wire cable or similar means to an actuating lever. The lever causes pressure to be exerted against a tension-adjusting ring over which the drumhead is stretched. A drum which is adjustable in pitch by rotation of the drum shell can thus be made adjustable by use of a pedal as well, leaving both hands of the drummer free during retuning.

9 Claims, 4 Drawing Figures

PEDAL ADJUSTABLE DRUM

BACKGROUND OF THE INVENTION

The present invention relates to drums, and more particularly to drums whose pitch is adjustable by rotation of the drum shell and/or activation of a pedal connected to drumhead-tensioning apparatus.

It is well known in the art to adjust the pitch of a drum by varying the tension on the drumhead. Devices for achieving this function have typically been used in conjunction with tympani, and have consisted of assemblies whereby activation of a pedal stretches the drumhead to increase the pitch. Tympani are also known which are adjustable in pitch by rotation of the drum shell about a central support axis. While combined pitch adjustability by rotation as well as by a pedal arrangement has been found in the prior art, the pedal-adjustable feature of such drums has typically required a large, heavy, cumbersome apparatus which is not separable from the drum itself.

Another type of drum whose pitch may be varied by rotation is a drum which has been manufactured and sold for a number of years by the assignee of the present application under the trademark "RotoTom". A "RotoTom" drum has a drumhead stretched over an upper die casting or "spider" and held by a counter hoop. The upper die casting has a central hub against whose lower surface abuts a threaded shaft. Threaded upon the threaded shaft is a lower die casting or spider rigidly affixed to the counter hoop. Rotation of the lower die casting about the threaded shaft causes the force exerted on the drumhead by the upper die casting to vary, thus changing the pitch of the RotoTom drum.

No means has yet been made available for adjusting the pitch of a "RotoTom" drum by means of a pedal. Thus, it has heretofore been required to use at least one hand to change the pitch of a "RotoTom" drum, so that a drummer was not free to play the instrument with both hands while performing a pitch adjustment.

SUMMARY OF THE INVENTION

According to the present invention there is provided an apparatus for adjusting the pitch of a "RotoTom" drum or similar drum by means of a pedal connected by a cable or similar means to an actuating mechanism. The invention contemplates boring a hole through and coaxial with the central threaded shaft of a "RotoTom" drum, inserting a push rod therethrough, and activating the push rod by a cable or the like attached to a foot pedal to force the push rod against the central hub of the upper die casting to vary the tension of the drumhead stretched thereover. The invention is equally applicable to other types of drums which may be adapted to be adjustable in pitch.

Accordingly, it is an object of the present invention to provide an improved pedal-adjustable drum.

It is a further object of the present invention to provide an improved apparatus whereby the pitch of an adjustable pitch drum may be varied while simultaneously leaving both hands of the drummer free to play the instrument.

These and other objects and advantages of the present invention will become apparent from the following detailed description taken in conjunction with the accompanying drawings.

DETAILED DESCRIPTION OF THE INVENTION

Figures 1, 2:
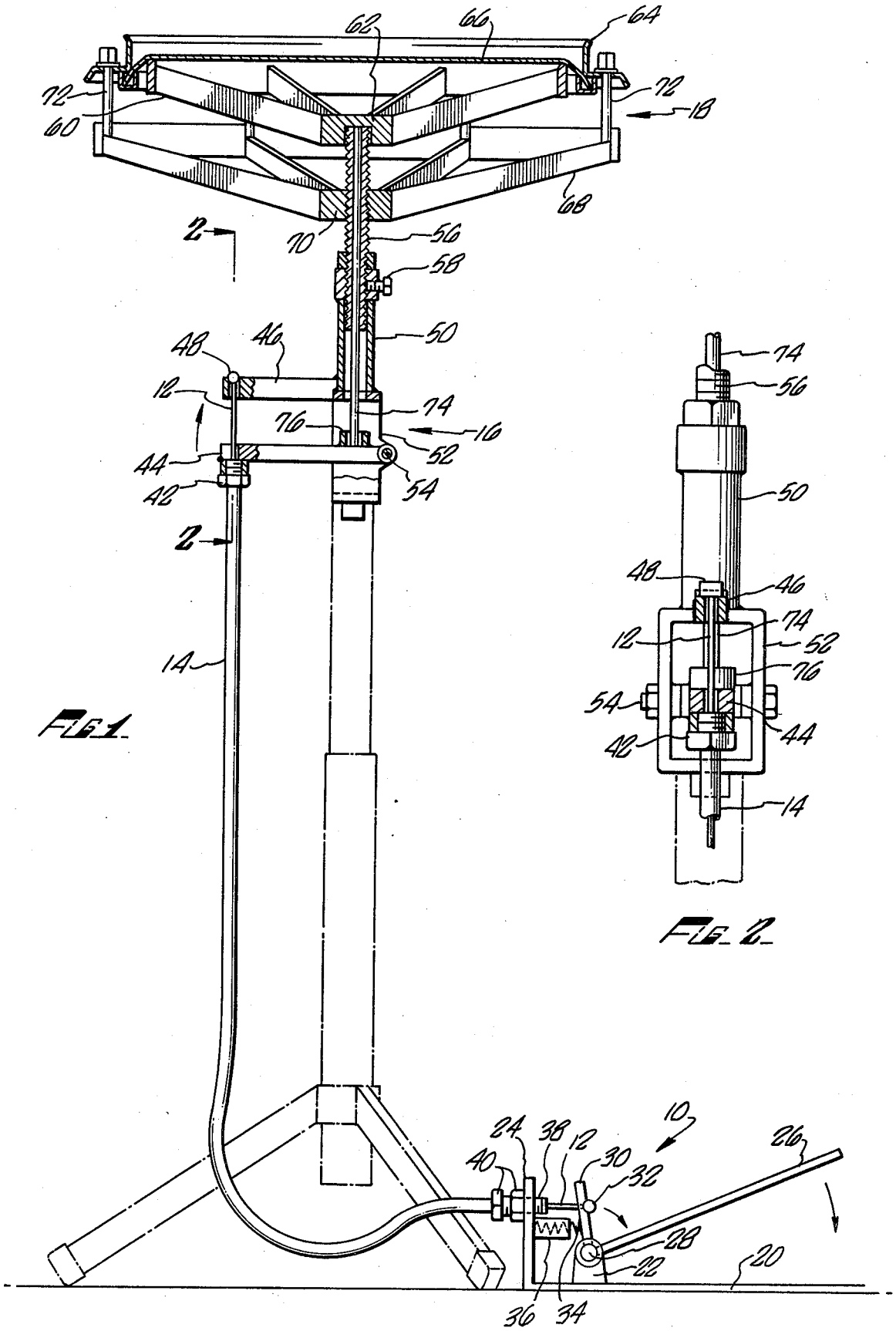
FIG. 1 is a side elevation, in partial cross-section and partially in phantom, of an embodiment of the present invention shown in conjunction with a RotoTom drum for pedal adjustment of the pitch thereof.
FIG. 2 is a side view, in partial cross-section, of the mounting bracket of the embodiment shown in FIG. 1 taken along the line 2—2 of FIG. 1.

FIG. 1 illustrates an apparatus for pedal adjustment of a "RotoTom" drum according to the present invention, comprising generally a pedal mechanism 10, a wire cable 12 encased and freely movable within a jacket 14, and a mounting bracket assembly 16, and having a "RotoTom" drum 18 mounted thereon. The pedal mechanism 10 comprises a base 20 on which are mounted a pivot post 22 and a bracket 24. A pedal 26 pivots about a pin 28 mounted on the pivot post 22, and attached to the pedal 26 is a tensioning bracket 30 having a small aperture therein to permit the cable 12 to pass therethrough. At the end of the cable 12 after it has passed through the aforesaid aperture is a ball 32 affixing the end of the cable 12 to the bracket 30. Mounted between the bracket 24 and the tensioning bracket 30 is a return spring 34, and also affixed therebetween is a stop 36 which limits the movement of the tensioning bracket 30 and thus the pedal 26 under the influence of the return spring 34.

A threaded connector 38 is attached to the end of the jacket 14 nearest the pedal mechanism 10, and may be provided with fasteners 40 such as nuts or the like to secure the connector 38 to the bracket 24 and thus permit the cable 12 to pass therethrough. At the other end of the jacket 14 there is affixed a threaded fastener 42 which may be threadably engaged with a lever arm 44 of the mounting bracket assembly 16. The wire cable 12 extends beyond the end of the jacket 14 through an aperture in the lever arm 44 and through a substantially coaxial aperture in a fixed cable support arm 46 which is also part of the mounting bracket assembly 16. At the upper end of the cable 12 is a ball 48 affixing the end of the cable 12 to the arm 46.

The cable support arm 46 is rigidly affixed to a mounting bracket 50, which may comprise a hollow cylindrical pipe or the like and which may be supported by a pivot housing bracket 52. The lever arm 44 is attached to the housing bracket 52 by a pin 54 secured thereto, and pivots about the pin 54. The upper end of the mounting bracket 50 may be threaded on the interior surface thereof, for receiving the central threaded shaft 56 of the "RotoTom" drum 18. Locking means 58 may also be provided to secure the shaft 56 within the bracket 50.

In addition to the shaft 56, the "RotoTom" drum 18 includes an upper die casting or "spider" 60 having a central hub 62 against which the upper end of the shaft 56 abuts, a counter hoop 64 securing a drumhead 66 over the upper die casting 60, and a lower die casting or spider 68 having a central hub 70 which is threaded upon the shaft 56. The lower die casting 68 is rigidly affixed to the counter hoop 64 by fastening means 72.

A portion of the housing bracket 52 is broken away in FIG. 1, revealing a push rod 74 extending therethrough and through the shaft 56. As is also illustrated in FIG. 2, which is a side view of the mounting bracket assembly 16 taken along the line 2—2 of FIG. 1, the push rod 74 is seated in a push rod seat 76 formed in the lever arm 44. Thus with movement of the lever arm 44 about the pin 54, the push rod 74 may be caused to slide in a vertical direction within the threaded shaft 56. The mounting bracket assembly 16 may be supported upon any conventional musical stand, such as is shown in phantom in FIG. 1, which is suitable for supporting drums.

The principles of operation of the above-described device will now be readily apparent. Initially, the fasteners 40 are adjusted to position the threaded connecter 38 such that the wire cable 12 and the jacket 14 thereof are tensioned sufficiently to achieve a minimum desired tension on the drumhead 66. When higher pitch is desired, the drummer depresses the pedal 26, causing the wire cable 12 to extend because of the ball 32 affixed to the end thereof. Since the ball 48 is attached to the other end of the wire cable 12, preventing the wire cable from moving with respect to the cable support arm 46, the depression of the pedal 26 causes pressure to be exerted upon the lever arm 44 at its point of connection, through the fastener 42, to the jacket 14. While the jacket 14 is sufficiently flexible to permit it to bend with the wire cable 12, it should have sufficient rigidity in the longitudinal direction to exert the required forces. As the pedal 26 is depressed, therefore, the lever arm 44 is forced upward by the pressure of the jacket 14 thereagainst, causing the push rod 74 seated in the push rod seat 76 of the lever arm 44 to be moved upward through the threaded shaft 56 and thereby forced against the underside of the central hub 62 of the upper die casting 60. This upwardly directed pressure increases the tension on, and thus the pitch of, the drumhead 66. The "RotoTom" drum can still be tuned, if desired, in the standard method, by rotating the lower die casting about the threaded shaft as previously described. For convenience of transportation, the "RotoTom" drum is easily removable from the bracket 50 by unscrewing the threaded shaft 56 therefrom.

Figure 3:
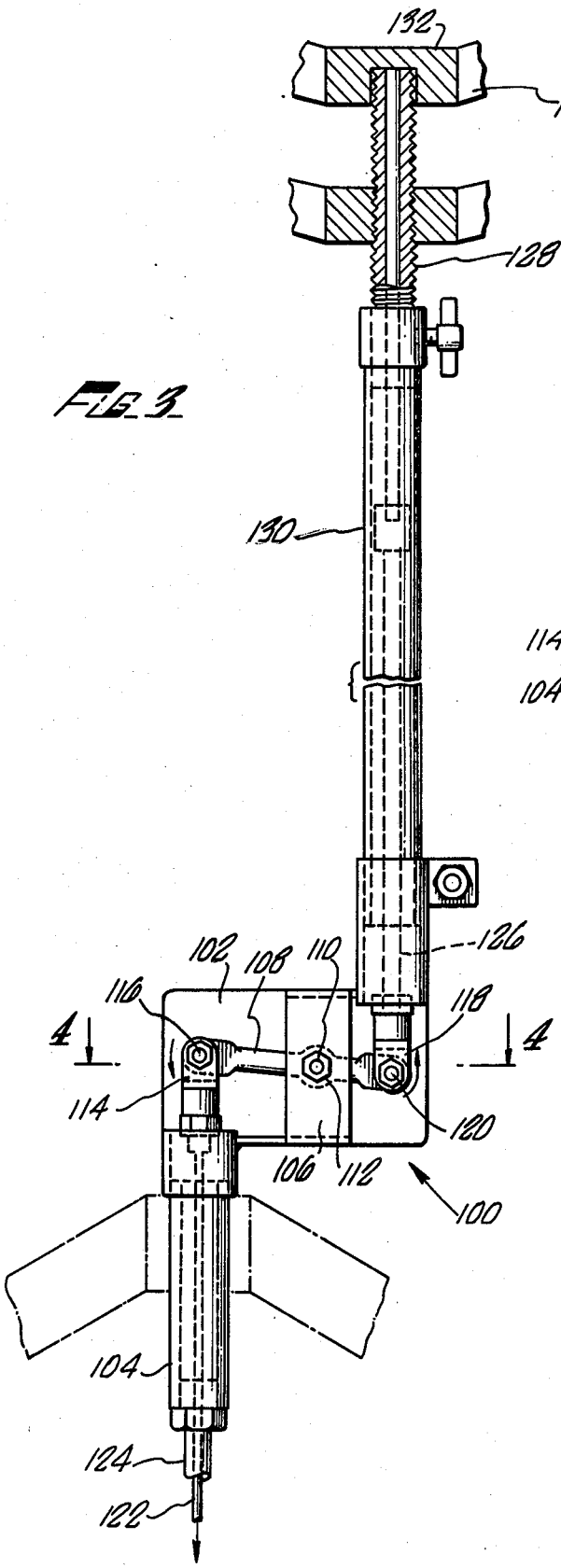
FIG. 3 is a side view of a mounting bracket according to a second embodiment of the present invention.
Figure 4:
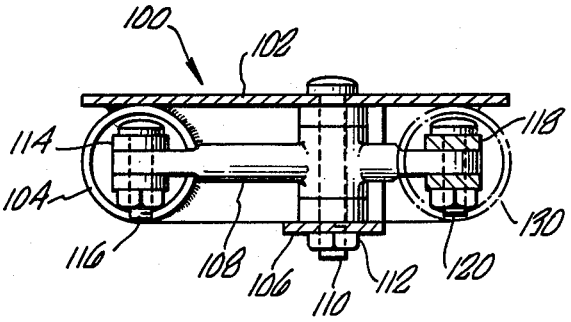
FIG. 4 is a top view, in cross-section, of the mounting bracket of FIG. 3, taken along the line 4—4 of FIG. 3.

In FIGS. 3 and 4 there is illustrated a second embodiment of a mounting bracket assembly 100 for tensioning a "RotoTom" drum (shown in partial view only) through actuation of a pedal (not shown). The mounting bracket assembly 100 comprises a mounting bracket 102 having affixed thereto a support bracket 104 which may be mounted upon a drum stand (partially shown in phantom) in the matter previously described. A lever arm bracket 106 is affixed to the mounting bracket 102, and supports a lever arm 108 secured thereto by a pin 110 and fastener means 112.

A connector 114 is swivelly attached to one end of the lever arm 108 by a pin 116, and in a similar manner, a connector 118 is attached to the other end of the lever arm 108 by a pin 120. Each of the connectors 114 and 118 is threaded at the end opposite the point of attachment to the lever arm 108. Coupled with the connector 114 by means of suitable threaded connectors is a wire cable 122 which may be surrounded by a jacket 124 and connected to a foot pedal, not shown, in any suitable manner such as that shown in FIG. 1, such that depression of the foot pedal downwardly displaces the cable 122. Threadably engaged with the connector 118 is a push rod 126 adapted to extend through the bored central shaft 128 of the "RotoTom" drum in the same manner as previously described. The central shaft 128 may be threadably received within a support bracket 130, also substantially in the manner previously described.

In operation, depression of the pedal causes the cable 122 to move downward, pivoting the lever arm 108 about the pin 110 and thereby causing the push rod 126 to exert pressure against the central hub 132 of the upper die casting 134, as previously described, thus tensioning the drumhead.

While alternative embodiments of the present invention have been illustrated and described, it will be apparent to those skilled in the art that many variations and modifications thereof may be made without departing from the teachings herein, and it is intended that all such variations and modifications be encompassed within the scope of the appended claims.

I claim:

1. A pedal adjustable drum assembly comprising a drum having a drumhead stretched over a tensioning ring and affixed to a counter hoop, said ring being attached to a central hub by members radiating from said hub, a push rod adapted to engage said hub opposite said drumhead such that the tension exerted on said drumhead is increased when said push rod is forced against said hub, pivoted lever means adapted to engage said push rod opposite said hub, support bracket means connected to said pivoted lever means for supporting said drum, foot pedal means, and actuating means connecting said foot pedal means and said pivoted lever means for pivoting said pivoted lever means against said push rod upon actuation of said foot pedal means and thereby varying the pitch of said drum.

2. Apparatus for pedal adjustment of the pitch of a drum comprising a foot pedal, a support bracket adapted to support a drum, actuating means carried by said support bracket and connected to said foot pedal for activation thereby, and drumhead tensioning means engaged with said actuating means adapted to be actuated thereby upon activation of said foot pedal, said drumhead tensioning means including a rod adapted to be disposed substantially perpendicularly to a drumhead to be tensioned and a ring over which a drumhead may be stretched, the ring including a central hub, the rod being adapted to engage the hub.

3. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, support means for supporting said drum, foot pedal means, and actuating means engaged with said foot pedal means and operated by said foot pedal means for applying drumhead tensioning force to said central hub to thereby vary the pitch of said drum.

4. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, said counter hoop including a central hub attached thereto and threaded upon a threaded shaft, said tensioning ring central hub being between said drumhead and said counter hoop central hub, said counter hoop central hub being rotatable about said threaded shaft to vary the pitch of said drum, support means for supporting said drum, foot pedal means, and actuating means engaged with said foot pedal means and operated by said foot pedal means for actuating said tensioning ring central hub to also thereby vary the pitch of said drum.

5. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, said counter hoop including a central hub attached thereto, said tensioning ring central hub being intermediate said drumhead and said counter hoop central hub, a hollow threaded shaft about which said central hub of said counter hoop is threaded, said hollow threaded shaft adapted to engage said tensioning ring central hub and said counter hoop being rotatable about said threaded shaft to vary the pitch of said drum, a push rod carried within said hollow threaded shaft, support bracket means for supporting said drum, foot pedal means, and actuating means connected to said foot pedal means and operated by said foot pedal means and engaged with said push rod for actuating said push rod within said threaded shaft, an end of said push rod further adapted to engage said central hub of said tensioning ring to thereby also vary the pitch of said drum in response to actuation of said foot pedal means.

6. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, said counter hoop including a central hub attached thereto, said tensioning ring central hub being intermediate said drumhead and said counter hoop central hub, a hollow threaded shaft about which said central hub of said counter hoop is threaded, said hollow threaded shaft adapted to engage said tensioning ring central hub and said counter hoop being rotatable about said threaded shaft to vary the pitch of said drum, a push rod carried within said hollow threaded shaft, actuating means adapted to be connected to foot pedal means and engaged with said push rod for actuating said push rod within said threaded shaft, an end of said push rod further adapted to engage said central hub of said tensioning ring to thereby also vary the pitch of said drum in response to actuation of said push rod, and support bracket means for supporting said drum.

7. A pedal adjustable drum assembly comprising a drum having a drumhead stretched over a tensioning ring and affixed to a counter hoop, said ring being attached to a central hub by members radiating from said hub, a push rod adapted to engage said hub opposite said drumhead, such that the tension exerted on said drumhead is increased when said push rod is forced against said hub, pivoted lever means adapted to engage said push rod opposite said hub, support bracket means connected to said pivoted lever means for supporting said drum, foot pedal means, actuating means connecting said foot pedal means and said pivoted lever means for pivoting said pivoted lever means against said rod upon actuation of said foot pedal means and thereby varying the pitch of said drum, and said counter hoop including a spider affixed thereto, said spider threaded upon a threaded shaft through which said push rod extends coaxially, whereby the pitch of said drum may also be varied by rotating said spider about said threaded shaft.

8. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, a second central hub attached to said counter hoop and threaded upon a threaded shaft, said tensioning ring central hub being between said drumhead and said second central hub, said second central hub being rotatable about said threaded shaft to vary the pitch of said drum, support means for supporting said drum, foot pedal means, and actuating means engaged with said foot pedal means and operated by said foot pedal means for applying drumhead tensioning force to said tensioning ring central hub to thereby also vary the pitch of said drum.

9. An apparatus for pedal adjustment of the pitch of a drum wherein the drum includes a drumhead, the apparatus comprising a tensioning ring including a central hub, a counter hoop adapted to engage said drumhead and to stretch said drumhead over said tensioning ring, a second central hub attached to said counter hoop and threaded upon a threaded shaft, said tensioning ring central hub being between said drumhead and said second central hub, said second central hub being rotatable about said threaded shaft to vary the pitch of said drum, support means for supporting said drum, foot pedal means, and actuating means for applying drumhead tensioning force to said tensioning ring central hub, said actuating means including a push rod carried by said threaded shaft, said push rod being adapted to engage said tensioning ring central hub, and means engaged with said foot pedal for actuating said push rod to thereby also vary the pitch of said drum.

* * * * *